US007010132B2

(12) United States Patent
Luo et al.

(10) Patent No.: US 7,010,132 B2
(45) Date of Patent: Mar. 7, 2006

(54) AUTOMATIC MAGNETIC DETECTION IN HEARING AIDS

(75) Inventors: Henry Luo, Waterloo (CA); Horst Arndt, Kitchener (CA); André Vonlanthen, Waterloo (CA); Mark Schmidt, Breslau (CA)

(73) Assignee: Unitron Hearing Ltd., Kitchener (CA)

( * ) Notice: Subject to any disclaimer, the term of this patent is extended or adjusted under 35 U.S.C. 154(b) by 0 days.

(21) Appl. No.: 10/452,731

(22) Filed: Jun. 3, 2003

(65) Prior Publication Data

US 2004/0247145 A1 Dec. 9, 2004

(51) Int. Cl.
*H04R 25/00* (2006.01)

(52) U.S. Cl. ..... 381/312; 381/331

(58) Field of Classification Search ..... 381/23.1, 381/312, 314, 315, 320, 321, 123, 327, 328, 381/330, 331; 379/52
See application file for complete search history.

(56) References Cited

U.S. PATENT DOCUMENTS

| | | | | |
|---|---|---|---|---|
| 5,463,692 | A | 10/1995 | Fackler | |
| 5,524,056 | A | 6/1996 | Killion et al. | |
| 5,553,152 | A | 9/1996 | Newton | |
| 5,659,621 | A | 8/1997 | Newton | |
| 5,909,497 | A | 6/1999 | Alexandrescu | |
| 6,633,645 | B1 * | 10/2003 | Bren et al. | 381/1 |
| 6,760,457 | B1 * | 7/2004 | Bren et al. | 381/331 |
| 2002/0039428 | A1 | 4/2002 | Svajda et al. | |
| 2002/0186857 | A1 | 12/2002 | Bren et al. | |
| 2002/0191804 | A1 | 12/2002 | Luo et al. | |

FOREIGN PATENT DOCUMENTS

| | | |
|---|---|---|
| EP | 1296537 A2 | 3/2003 |
| WO | WO 98/16086 | 4/1998 |
| WO | WO 00/18187 | 3/2000 |
| WO | WO 00/21335 | 4/2000 |
| WO | WO 01/52597 A1 | 7/2001 |
| WO | WO 02/23950 A2 | 3/2002 |

* cited by examiner

*Primary Examiner*—Huyen Le

(57) ABSTRACT

A hearing aid system and method for processing one of an input magnetic signal, having magnetic information, and at least one acoustic input signal having acoustic information. The system comprises an acoustic sensor for providing the input acoustic signal, a magnetic sensor for providing the input magnetic signal, and a magnetic signal detector for selecting one of the input acoustic signal and the input magnetic signal as an information signal. The magnetic signal detector selects the input magnetic signal as the information signal when a magnetic signal detection process has at least partially analyzed the input magnetic signal to determine if audio information may be present. The hearing aid system further comprises a hearing aid module for processing the information signal and providing an output signal to a user of the hearing aid system.

30 Claims, 4 Drawing Sheets

AUTOMATIC MAGNETIC DETECTION IN HEARING AIDS

FIELD OF THE INVENTION

This invention relates to magnetic detection for audio systems, and in particular, to magnetic detection for hearing aids for selectively processing either an input acoustic signal or an input magnetic signal.

BACKGROUND OF THE INVENTION

Hearing aids are often manufactured with an acoustic sensor (i.e. a microphone) as well as a magnetic sensor (i.e. a tele-coil). The acoustic sensor is used as the principal sensor for sensing an input acoustic signal that contains acoustic information which may comprise audio information (i.e. speech, music or other important sounds such as alarms, warnings, etc.). The magnetic sensor is an alternate sensor that is used in certain situations for sensing an input magnetic signal that contains magnetic information that is in many instances similar to the audio information. Use of the magnetic sensor can be beneficial in various situations.

For instance, it is common to install magnetic loop systems in classrooms to improve the comprehension of audio information for hearing impaired students. The magnetic loop system comprises a wire that is placed in the baseboard of a room such as a classroom. In this case, an instructor speaks into a microphone which transduces the instructor's speech and provides an electrical signal to the magnetic loop which radiates a corresponding magnetic signal, having magnetic information which is similar to the audio information corresponding to the original speech signal, to people who are sitting in the room. Advantageously, the magnetic signal, which is an input for the magnetic sensor of the hearing aid, will not contain the acoustic background noise that is picked up by the acoustic sensor of the hearing aid.

In another example, it is well known that most telephones utilize magnetic fields to vibrate the receiver diaphragm in the telephone earpiece to produce an acoustic signal with audio information. The magnetic fields contain amplitude and frequency components that are similar to the audio information. Accordingly, the magnetic fields can be used as a magnetic signal with magnetic information that is similar to the audio information. However, the magnetic signal will not contain the acoustic background noise that is typically added to the acoustic signal by the environment after the receiver produces the acoustic signal. Therefore, the magnetic signal can be used to assist hearing aid users with telephone communication in noisy surroundings. In addition, the use of the magnetic signal from the telephone receiver as an input to the hearing aid prevents acoustic feedback from occurring because, in this case, the input signal to the hearing aid is magnetic while the output signal from the hearing aid is acoustic and there is no acoustic coupling between these signals.

Most prior art hearing aids provide both an acoustic sensor and a magnetic sensor but require the hearing aid user to manually switch between a microphone mode, in which the hearing aid processes the acoustic signal sensed by the acoustic sensor, and a tele-coil mode, in which the hearing aid processes the magnetic signal sensed by the magnetic sensor. Accordingly, when the hearing aid user enters an environment with a magnetic loop or the hearing aid user talks on the telephone, the hearing aid user needs to switch the hearing aid from the microphone mode to the tele-coil mode. Likewise, when the hearing aid user leaves the magnetic-looped environment or hangs up the telephone, the hearing aid user needs to switch the hearing aid to the microphone mode. Unfortunately, manual switch operation can be cumbersome. Moreover, engaging a switch in a hearing aid that is worn within the ear canal is usually difficult, and at times, impossible.

The magnetic receiver in a telephone usually contains a permanent magnet, and consequently there will be a permanent (DC) magnetic field in the vicinity of the telephone receiver. Accordingly, some prior art hearing aids that provide both microphone and tele-coil input modes use a magnetic reed switch that closes in the presence of a DC magnetic field to automatically switch between microphone and tele-coil inputs. However, the automatic switching only works when the DC magnetic field is sufficiently strong to actuate the magnetic reed switch. Many modern telephones and cell phones do not produce a permanent magnetic field of sufficient strength to actuate a magnetic reed switch. In addition, there may be occasions in which the hearing aid user is in an environment in which there is a strong magnetic field but the magnetic field does not contain any desired information that corresponds to audio information. In this case, a hearing aid using a magnetic reed switch will automatically switch to the tele-coil mode but the hearing aid user will not hear any useful signals.

Loop systems do not generate a DC magnetic field, and a reed switch will not be activated when a loop system is encountered. However, all loop systems and many telephones do produce alternating magnetic signals, and it is advantageous for a magnetic detection system to be sensitive to such alternating magnetic signals.

SUMMARY OF THE INVENTION

In a first aspect, the present invention provides a hearing aid system comprising: a) an acoustic sensor for sensing an acoustic signal and providing an input acoustic signal, the input acoustic signal having acoustic information; b) a magnetic sensor for sensing a magnetic field signal and providing an input magnetic signal, the input magnetic signal having magnetic information; and c) a magnetic signal detector connected to the magnetic sensor and the acoustic sensor for selecting one of the input magnetic signal and the input acoustic signal as an information signal. The magnetic signal detector selects the input magnetic signal as the information signal when a magnetic signal detection process has at least partially analyzed the input magnetic signal in order to determine if the input magnetic signal may include audio information. The hearing aid system further comprises a hearing aid module connected to the magnetic signal detector for processing the information signal and providing an amplified output signal to a user of the hearing aid system.

In another aspect, the present invention provides a method of operating a hearing aid system comprising:

a) sensing an acoustic signal and providing an input acoustic signal, the input acoustic signal having acoustic information;

b) sensing a magnetic field signal and providing an input magnetic signal, the input magnetic signal having magnetic information;

c) selecting one of the input acoustic signal and the input magnetic signal as an information signal, wherein the input magnetic signal is selected as the information signal after a magnetic detection process has at least partially analyzed the input magnetic signal in order to determine if audio information may be present in the input magnetic signal; and d) processing the information signal and providing an output signal to a user of the hearing aid system.

In a further aspect, the present invention provides a tele-coil circuit for a hearing aid system comprising: a) a tele-coil for sensing a magnetic field signal and providing an input magnetic signal to the hearing aid system, the input magnetic signal having magnetic information; and b) a magnetic signal pre-detector connected to the tele-coil for at least partially analyzing some portions of the input magnetic signal in order to determine whether audio information may be present and providing a status signal to the hearing aid system. The status signal indicates that portions of the magnetic information may include audio information.

In another aspect, the present invention provides a hearing aid system comprising an acoustic sensor for sensing an acoustic signal and providing an input acoustic signal, the input acoustic signal having acoustic information; a magnetic sensor for sensing a magnetic field signal and providing an input magnetic signal, the input magnetic signal having magnetic information; and a magnetic signal detector connected to the magnetic sensor and the acoustic sensor for selecting one of the input acoustic signal and the input magnetic signal as an information signal. The magnetic signal detector employs a two-stage magnetic detection process, wherein a first stage of the two-stage magnetic detection process at least partially analyzes the input magnetic signal in order to determine whether audio information may be present in a portion of the input magnetic signal and wherein a second stage of the two-stage magnetic detection analyzes the portion of the input magnetic signal to determine if the portion of the magnetic information includes audio information. The second stage is performed when the first stage indicates that audio information may be present in the input magnetic signal. The hearing aid further comprises a hearing aid module connected to the magnetic signal detector for processing the information signal and providing an output signal to a user of the hearing aid system.

In another aspect, the present invention provides a hearing aid system comprising an acoustic sensor for sensing an acoustic signal and providing an input acoustic signal, the input acoustic signal having acoustic information; a magnetic sensor for sensing a magnetic field signal and providing an input magnetic signal, the input magnetic signal having magnetic information; and a magnetic signal detector connected to the magnetic sensor and the acoustic sensor for selecting one of the input acoustic signal and the input magnetic signal as an information signal. The magnetic signal detector selects the input magnetic signal as the information signal after a magnetic signal detection process has at least partially analyzed an alternating portion of the input magnetic signal in order to determine if the input magnetic signal may contain audio information. The hearing aid further comprises a hearing aid module connected to the magnetic signal detector for processing the information signal and providing an output signal to a user of the hearing aid system.

In another aspect, the present invention provides a method of operating a hearing aid system comprising: sensing an acoustic signal and providing an input acoustic signal, the input acoustic signal having acoustic information; sensing a magnetic field signal and providing an input magnetic signal, the input magnetic signal having magnetic information; and selecting one of the input acoustic signal and the input magnetic signal as an information signal. The input magnetic signal is selected as the information signal after a magnetic signal detection process has at least partially analyzed an alternating portion of the input magnetic signal in order to determine if the input magnetic signal may contain audio information. The method further comprises processing the information signal and providing an output signal to a user of the hearing aid system.

BRIEF DESCRIPTION OF THE DRAWINGS

For a better understanding of the present invention and to show more clearly how it may be carried into effect, reference will now be made, by way of example only, to the accompanying drawings which show exemplary embodiments of the present invention and in which.

DETAILED DESCRIPTION OF THE INVENTION

Figure 1:
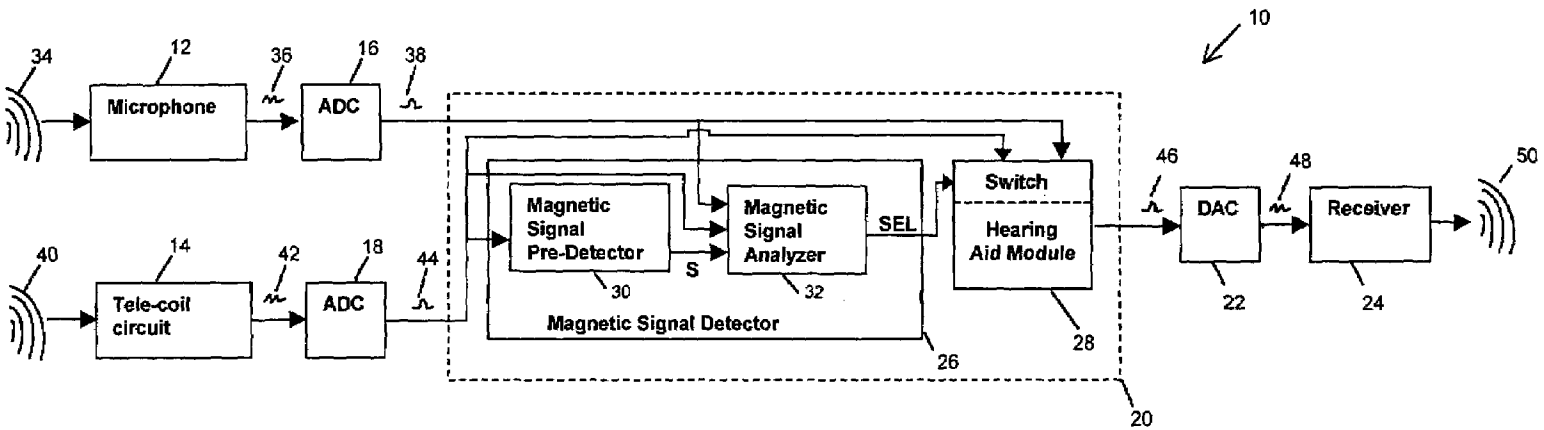
FIG. 1 is a schematic block diagram of a hearing aid system with a magnetic signal detector for switching between an input magnetic signal and an input acoustic signal in accordance with the present invention.

Referring now to FIG. 1, shown therein is a schematic block diagram of a hearing aid system 10 for automatically switching between an input magnetic signal and an input acoustic signal in accordance with the present invention. The hearing aid system 10 comprises at least one acoustic sensor 12, a magnetic sensor 14, two analog-to-digital converters (ADC) 16 and 18, a system processor 20, a digital-to-analog converter (DAC) 22 and a receiver 24 connected as shown in FIG. 1. If the receiver 24 is a zero-bias receiver then the DAC 22 may be omitted.

The acoustic sensor 12 provides an input acoustic signal for the system processor 20, which is used as the primary input for the hearing aid system 10, and the magnetic sensor 14 provides an input magnetic signal for the system processor 20, which is used as the secondary input for the hearing aid system 10. The acoustic sensor 12 is a microphone but in general may be any type of sound transducer that is capable of receiving a sound signal and providing a corresponding analog electrical signal. The magnetic sensor 14 is a tele-coil circuit but in general may be any type of magnetic transducer capable of receiving a magnetic field signal and providing a corresponding analog electrical signal. The tele-coil circuit 14 may comprise a passive coil that simply consists of a number of turns of wire around a magnetic core or an active tele-coil that comprises a coil and a preamplifier. An active tele-coil is preferable since an active tele-coil usually delivers a much stronger electrical signal with a better signal to noise ratio than a passive tele-coil would. Other circuitry may also be incorporated into the tele-coil circuit 14 as described in further detail below.

The system processor 20 processes one of the input acoustic signal and the input magnetic signal to provide an output signal to a user of the hearing aid system 10. The system processor 20 usually processes the input acoustic signal provided by the microphone 12. However, the system processor 20 can automatically process the input magnetic signal provided by the tele-coil circuit 14 when the magnetic information of the input magnetic signal comprises audio information. This audio information can be identified by at least one of the temporal, amplitude and frequency characteristics of the input magnetic signal. In this context, audio information is desired information such as speech, music, warning signals and the like. This occurs in environments in which a magnetic field signal is provided with magnetic information that comprises audio information such as in a magnetic-loop environment (in a classroom or church for example) or when the hearing aid user talks on a hearing aid compatible telephone.

The system processor 20 comprises a magnetic signal detector 26 and a hearing aid module 28. The magnetic signal detector 26 determines whether the input magnetic signal should be processed by analyzing the time-varying components of the input magnetic signal. The magnetic signal detector 26 comprises a magnetic signal pre-detector 30 and a magnetic signal analyzer 32, both of which are described in more detail below, for performing a magnetic signal detection process for automatically selecting one of the input magnetic signal and the input acoustic signal for further processing. The magnetic signal detector 26 provides a selection signal SEL for selecting one of the input acoustic signal and the input magnetic signal as an information signal. The hearing aid module 28 processes the information signal according to the type of input signal that is selected by the selection signal SEL. Accordingly, when the information signal is the input acoustic signal, the hearing aid module 28 operates in a microphone mode and executes an acoustic signal processing program. Alternatively, when the information signal is the input magnetic signal, the hearing aid module 28 operates in a tele-coil mode and executes a magnetic signal processing program. In general, the acoustic and magnetic signal processing programs may be any suitable hearing aid processing scheme known to those skilled in the art, and accordingly may employ noise reduction, linear processing or non-linear processing (i.e. compression), feedback cancellation and the like. The system processor 20 and its components may be implemented using a digital signal processor, or discrete electronic components, as is well known to those skilled in the art.

In use, the microphone 12 receives an acoustic signal 34 and transduces this signal to provide a corresponding electronic acoustic signal 36. The ADC 16 digitizes the electronic acoustic signal 36 to provide the digital input acoustic signal 38. The digital input acoustic signal 38 comprises acoustic information which may include audio information such as speech, music and the like. The digital input acoustic signal 38 also contains background noise which was transduced by the microphone 12. The background noise may have components in the same frequency range as the audio information. The hearing aid module 28 may have difficulty removing this background noise which will affect the ability of the hearing aid user to understand the audio information.

The tele-coil circuit 14 receives a magnetic field signal 40 and transduces this signal to provide a corresponding electronic magnetic signal 42. The ADC 18 digitizes the electronic magnetic signal 42 to provide the digital input magnetic signal 44. The digital input magnetic signal 44 comprises magnetic information which may be similar to the audio information contained in the input acoustic signal 38. However, the input magnetic signal 44 will not contain the acoustic background noise that was transduced by the microphone 12. Accordingly, when the magnetic information comprises audio information, it is preferable for the hearing aid module 28 to process the input magnetic signal 44 and provide the processed input magnetic signal 44 to a user of the hearing aid system 10.

The magnetic signal pre-detector 30 receives the input magnetic signal 44 and performs a first stage of the magnetic signal detection process by segmenting the input magnetic signal 44 into a plurality of input magnetic signal segments each having a portion of the magnetic information. The magnetic signal pre-detector 30 then provides a status signal S for indicating a likelihood that the portion of the magnetic information in the plurality of input magnetic signal segments comprise audio information. The processing that is performed by the magnetic signal pre-detector 30 is low-level processing having a low computational complexity. The status signal S is preferably a binary signal with a value for each of the plurality of input magnetic signal segments. The status signal S may have a value of 1 for an input magnetic signal segment that has a good likelihood or good probability of having magnetic information that comprises audio information. Alternatively, the status signal S may have a value of 0 for an input magnetic signal segment that has a low likelihood or low probability of having magnetic information that comprises audio information. In this latter case, the input magnetic signal 44 may simply contain noise. Alternatively, the status signal S need not be a binary signal but any type of signal that provides the likelihood indication. For instance, the status signal S may be a stream of integers bounded by a range wherein an integer at the high end of the range indicates a good likelihood and an integer at the low end of the range indicates a poor likelihood. When only noise exists in the input magnetic signal, the likelihood indication will be poor that the magnetic signal comprises audio information. In this case, the hearing aid system would automatically default to processing the input acoustic signal (i.e. operate in microphone mode).

The magnetic signal analyzer 32 receives the digital input acoustic signal 38, the digital input magnetic signal 44 and the status signal S, and provides the selection signal SEL to the hearing aid module 28. The hearing aid module 28 has a switch which receives the digital input acoustic signal 38, the digital input magnetic signal 44, and the section signal SEL. The switch selects one of the digital input acoustic signal 38 and the digital input magnetic signal 44 as the information signal for further processing by the hearing aid module 28. The hearing aid selection function is referred to as a switch for illustrative purposes, only. The SEL signal preferably causes the hearing aid module 28 to select the hearing aid program (i.e. microphone or tele-coil) that selects the appropriate input and processes the selected signal. The magnetic signal analyzer 32 performs a second stage of the magnetic signal detection process when the status signal S indicates a positive likelihood for several of the input magnetic signal segments. The second stage of the magnetic signal detection process comprises a high-level analysis of the magnetic information in the input magnetic signal segments which exhibited a positive likelihood of containing audio information. The higher-level analysis may be any analysis technique done in the time or frequency domain, as is well known to those skilled in the art, in which analysis of at least one of the temporal, amplitude and frequency characteristics of the magnetic signal segments is done to determine whether these segments contain audio information. The higher-level analysis is preferably a multidimensional signal detection process performed by the hearing aid module 28 to confirm the likelihood that the segments of the input magnetic signal contain audio information.

A multi-dimensional detection process is described in U.S. patent application Ser. No. 10/101,598 and is incorporated herein by reference. The three-dimensional detection process involves characterizing the contents of a signal by dividing the signal into a number of frequency domain input signals. Each frequency domain input signal can be processed separately to determine its intensity change, modulation frequency, and time duration characteristics to characterize the frequency domain input signal as containing a desirable signal. For this purpose, an index is calculated based on a combination of the determined characteristics to categorize the frequency domain input signals.

The intensity change characteristic is the change in the intensity (or volume) of the signal over a selected time period. In particular, the intensity change of the signal indicates the range of its intensity over the time period. The modulation frequency characteristic is the frequency of the signal's intensity modulation over a selected time period. In particular, the modulation frequency is the number of cycles in the intensity of the signal during a time period. For example, a signal that exhibits 30 peaks in its intensity over a one second period will have a modulation frequency of 30 Hz. The individual peaks will generally not have the same intensity, and may in fact be substantially different. The time duration characteristic is the signal's length in time.

Accordingly, the multi-dimensional detection process involves separately analyzing each frequency domain input signal to determine the change in the intensity of the signal during a selected time period and to produce an intensity change sub-index, which characterizes the frequency domain input signal (i.e. a frequency portion of the input magnetic signal) as noise or as a desired signal (i.e. a signal having audio information). Simultaneously, the frequency domain input signal is analyzed to determine the modulation frequency of the signal during a selected period (which may or may not be equal to the period selected to analyze changes in intensity) and to produce a modulation frequency sub-index, which characterizes the frequency domain input signal either as noise or as a desired signal.

The intensity change sub-index and modulation frequency sub-index are combined to produce a signal index which characterizes the frequency domain input signal along a two dimensional continuum defined by the change in intensity and modulation frequency criteria. The signal index is then used to classify the frequency domain input signal as noise or audio information. Alternatively, the frequency domain input signal may also be analyzed to determine the duration of its sound components and to produce a duration sub-index, which may be combined with the intensity change and modulation frequency sub-indices to produce a signal index on a three dimensional continuum.

The multi-dimensional detection process may be configured to use only one of the three characteristics (change in intensity, modulation frequency or time duration) to produce the signal index. Alternatively, any two or all three of the characteristics may be used. Furthermore, other characteristics of a sound signal may be used to classify the sound signal. For example, characteristics such as common onset/offset of frequency components, common frequency modulation, or common amplitude modulation may be used to characterize an audio signal.

This multi-dimensional detection process may also be used to improve the signal to noise ratio (SNR) of the input magnetic signal if the input magnetic signal is found to contain audio information. The SNR improvement involves identifying signals as noise and suppressing these signals in comparison to signals that are identified as desirable to produce a set of frequency domain output signals with reduced noise. The frequency domain output signals are then combined to provide an output signal with suppressed noise components and comparatively enhanced desirable signal components.

If the higher-level analysis indicates that the magnetic information in the digital input magnetic signal 44 contains audio information, then the magnetic signal analyzer 32 automatically selects the digital input magnetic signal 44 as the information signal and the hearing aid module 28 operates in the tele-coil input mode consistent with the tele-coil program. Otherwise, the magnetic signal analyzer 32 selects the digital input acoustic signal 38 and the hearing aid module 28 operates in the microphone input mode consistent with the microphone program.

In an alternative implementation, the magnetic signal analyzer 32 may further perform a comparison of the digital input magnetic signal 44 and the digital input acoustic signal 38 when the status signal S generated by the pre-detector indicates a good likelihood that several of the input magnetic signal segments comprise audio information, and the magnetic signal analysis shows a result that indicates a low likelihood that the magnetic signal contains audio information. This can occur in the rare case of a magnetic signal that contains, for example, a high level of impulsive noise. This additional level of processing is advantageous as it ensures correct signal classification without significantly increasing the computational complexity of the magnetic signal detection process since the processing associated with comparing the input audio signal and the input magnetic signal is performed only when the inconsistency described above is observed. In this way, the processing done in the second stage of the magnetic signal detection process is minimized for the complete magnetic signal detection process.

These processing schemes result in efficient operation of the hearing aid system 10 and a savings in power or current consumption. When the status signal S does not indicate a good likelihood for several of the input magnetic signal segments, the magnetic signal analyzer 32 simply selects the digital input acoustic signal 38. This will occur both prior to and after the situation in which the digital input magnetic signal 44 contains magnetic information that includes audio information. Accordingly, when the hearing aid user enters a magnetic loop environment or begins to speak on a telephone, the hearing aid module 26 automatically begins to process the digital input magnetic signal 44 and when the hearing aid user leaves the magnetic loop environment or is finished speaking on the telephone, the hearing aid module 26 automatically begins to process the digital input acoustic signal 38.

The number of input magnetic signal segments for which a good likelihood is required prior to the execution of the second stage of the magnetic signal detection process may be adjusted to alter the reaction time of the hearing aid system 10. For instance, in the case where each time segment is 0.5 milli-seconds in duration, it is advantageous to use 20 analysis segments thereby producing a total analysis window duration of 10 milli-seconds. The number of input magnetic signal segments may be a lower number, e.g. ten segments or a 5 milli-second analysis window, when a conclusive result is reached early. On the other hand, the analysis may require up to 40 segments, or an analysis window of 20 milli-seconds, when the result is not conclusive after 20 segments. The quickness with which the hearing aid system 10 automatically switches to processing the digital input magnetic signal 44 can be adjusted based on the needs of the user of the hearing aid system 10.

The hearing aid module 28 operates in either the microphone input mode or the tele-coil input mode (alternatively known as a microphone program or a tele-coil program) and processes the information signal to provide a digital output signal 46. The DAC 22 converts the digital output signal 46 into a corresponding analog output signal 48 which is then transduced by the receiver 24 into an output sound signal 50. The output sound signal 50 is provided to the user of the hearing aid system 10.

Figure 2B:
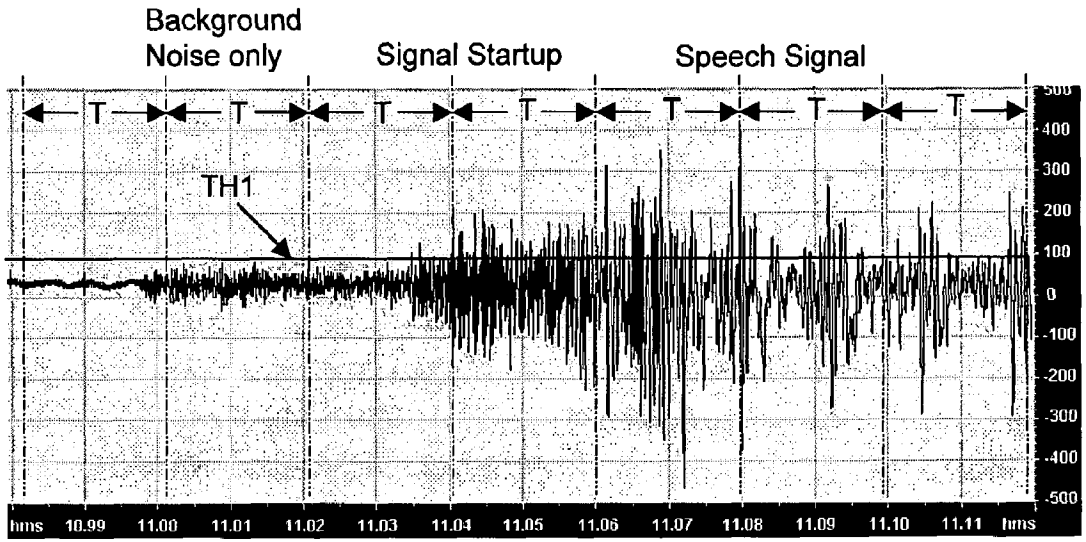
FIG. 2*b* is a data plot of an input magnetic signal that is being segmented and subjected to a threshold in accordance with the first stage of the magnetic signal detection process of FIG. 2*a;*
Figure 2A:
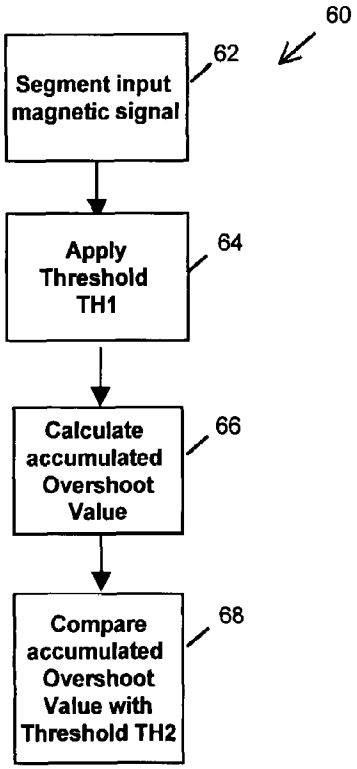
FIG. 2*a* is a flow chart of a first stage of a magnetic signal detection process employed by a magnetic signal pre-detector of the hearing aid system of FIG. 1.

During normal operation, the digital signal processing system of the hearing aid system 10 uses the majority of the available DSP cycles for processing an input signal and providing the output sound signal 50 to a user of the hearing aid system 10. Accordingly, it is beneficial to perform a portion of the magnetic signal detection process independently of the system processor 20. Referring now to FIGS. 2*a* and 2*b*, shown therein are a flowchart for the first stage (i.e. a magnetic signal pre-detection process 60) of the magnetic signal detection process and a time waveform representative of an input magnetic signal 42. A preferable implementation of the magnetic signal pre-detection process is as an analog time domain process but may also be implemented in the digital domain. The first step 62 of the magnetic signal pre-detection process 60 is to segment the input magnetic signal 42 into segments having a time duration T. The segments are preferably non-overlapping. However, the digital input magnetic signal 42 may also be segmented such that the segments overlap by a certain amount. A first threshold value TH1 is then applied to the segments of the input magnetic signal 42 in step 64 of the magnetic signal pre-detection process 60 so that an overshoot value can be calculated. The threshold value TH1 is selected such that the threshold value TH1 is larger than the background noise (as shown in FIG. 2*b*) in the input magnetic signal but lower than a low level input magnetic signal in which the magnetic information contains speech-like properties and therefore corresponds to audio information.

The accumulated overshoot value is then calculated in step 66 for preferably each segment of the digital input magnetic signal 42. The accumulated overshoot value is then compared to a second threshold value TH2 to obtain values for the status signal S in step 68. If the accumulated overshoot value is larger(smaller) than the threshold value TH2 for a given segment of the digital input magnetic signal 42, then a value of 1(0) is provided for the value of the status signal S that corresponds to the given segment. As mentioned previously, a status value of 1 indicates a good likelihood or good probability that a given segment of the input magnetic signal 42 contains audio information. The threshold values TH1 and TH2 are pre-defined values that are determined through experimentation. The levels of both TH1 and TH2 can be adjusted so that the magnetic signal pre-detection process performs optimally in any given environment, and for personal preference in the case where a user reacts very quickly and needs the hearing aid 10 to switch quickly as well. The value of TH1 is a function of the sensitivity of the magnetic sensor 14, the amount of preamplifier gain prior to the pre-detector, and the sensitivity of the pre-detector. Optimal values are empirically derived for specific environments and hearing aid settings. In addition, the segments of the input magnetic signal 42 may overlap. An example of a non-overlapping segmented analog input magnetic signal is shown in FIG. 2*b*.

There are several ways in which the accumulated overshoot value can be calculated. For instance, the segments of the input magnetic signal 42 may be monitored by integrating all signal components of the input magnetic signal which are over the threshold value TH1 according to:

$$AOS(T_{n-1}, T_n) = \frac{1}{2}\int_{T_{n-1}}^{T_n} [S(t) - THI] * \{\text{sign}[S(t) - THI] + 1\}\, dt \tag{1}$$

where AOS is the accumulated overshoot value calculated for a segment of the input magnetic signal 42 beginning at time $T_{n-1}$ and ending at time $T_n$, S(t) is the input magnetic signal and sign[ ] is the sign function which is +1 when S(t)>TH1 and is −1 when S(t)≦TH1. In this case AOS($T_{n-1}$, $T_n$) is the area above the threshold value TH1 for the input magnetic signal S(t) during the time period $T_{n-1}$ to $T_n$ since sign[S(t)-TH1]+1 is zero for portions of the input magnetic signal 42 which are less than the threshold value TH1. Accordingly, the segment of the input magnetic signal 42 comprises a plurality of samples and the integrand of the integral is a difference between an amplitude value of one of the plurality of samples and the threshold value TH1 with the integral being taken over the plurality of samples having an amplitude value greater than the threshold value TH1. The accumulated overshoot value is preferably calculated for each segment of the input magnetic signal 42.

In an alternative implementation, a segment of the input magnetic signal 42 may be monitored by converting the magnetic signal 42 into a time sampled signal and counting the number of samples which overshoot the threshold value TH1 during the time period T according to:

$$AOS(N_{m-1}, N_m) = \frac{1}{2}\sum_{N_{m-1}}^{N_m} \{\text{sign}[S(n) - THI] + 1\} \tag{2}$$

where the segment of the time sampled input magnetic signal 42 begins at sample $N_{m-1}$ and ends at sample $N_m$ and S(n) is a sampled version of the input magnetic signal S(t). This method of calculating the accumulated overshoot value advantageously reduces the computational complexity of the magnetic signal pre-detection process 60. Accordingly, the segment of the input magnetic signal 42 comprises a plurality of samples and the accumulated overshoot value is a sum of the plurality of samples having an amplitude value greater than the threshold value TH1. The accumulated overshoot value must be calculated for each segment of the time sampled input magnetic signal 42.

Figure 3A:
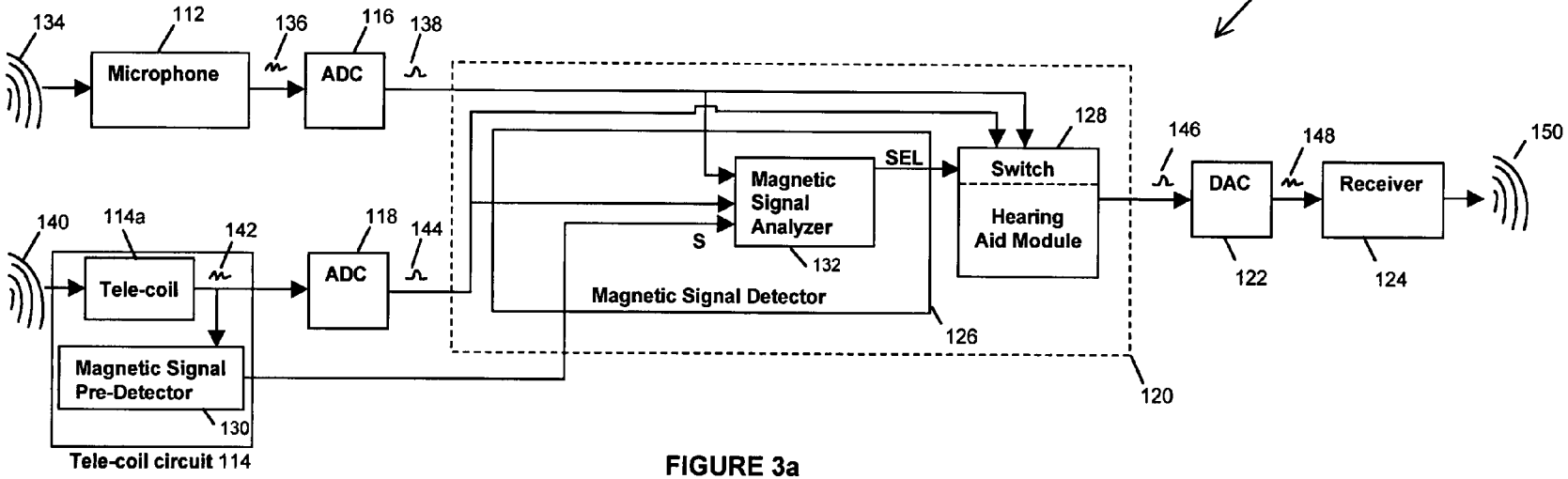
FIG. 3*a* is a block diagram of an alternative embodiment of a hearing aid system with a tele-coil circuit having a magnetic signal pre-detector in accordance with the present invention.

Referring now to FIG. 3*a*, shown therein is a block diagram of an alternative embodiment of a hearing aid system 100 with a tele-coil circuit 114 having a magnetic signal pre-detector 130 in accordance with the present invention. The hearing aid system 100 has the same components as the hearing aid system 10 and are labeled with reference numerals that are offset by 100. However, the hearing aid system 100 comprises a tele-coil circuit 114 that includes a tele-coil 114*a*, which is preferably an active tele-coil but may be a passive tele-coil, and the magnetic signal pre-detector 130. The magnetic signal pre-detector 130 operates in the same fashion as the magnetic signal pre-detector 30 but circuitry separate from the system processor 120 is used to implement the magnetic signal pre-detection process 60. The structure of the magnetic signal pre-detector 130 will be discussed in greater detail below.

Figure 3B:
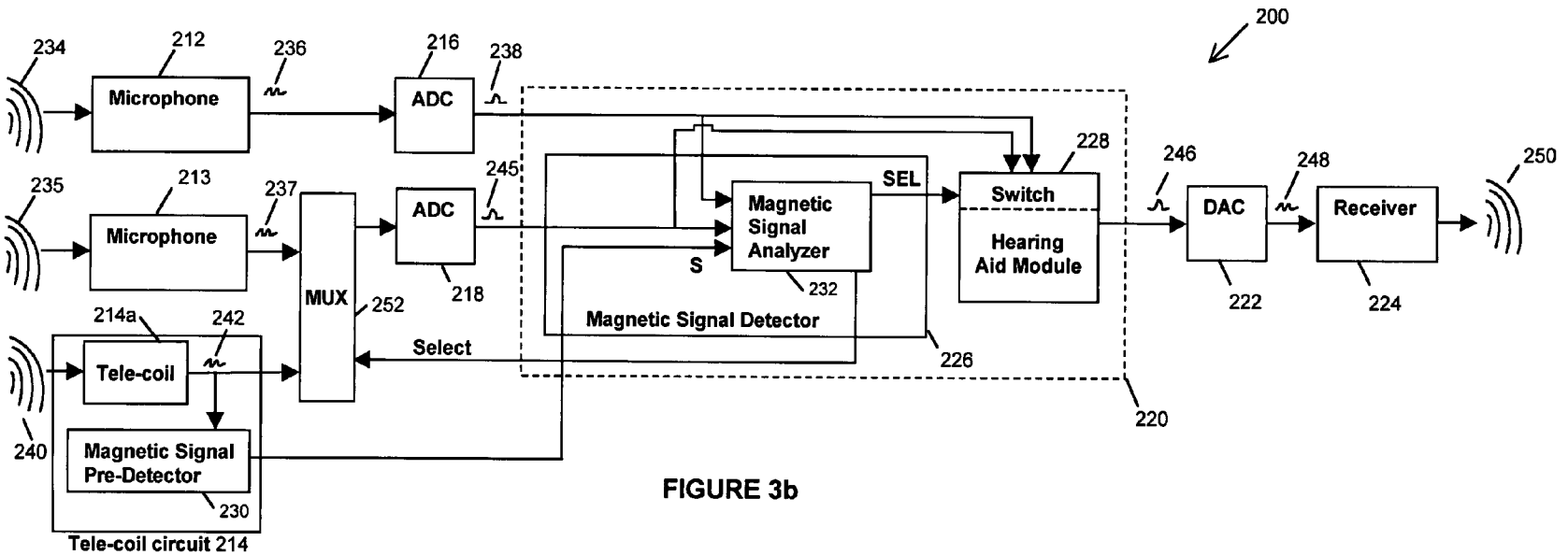
FIG. 3*b* is a block diagram of another alternative embodiment of a hearing aid system with two audio inputs and the tele-coil circuit of FIG. 3*a;*

Referring now to FIG. 3*b*, shown therein is a block diagram of another alternative embodiment of a hearing aid system 200 incorporating the tele-coil circuit of the hearing aid system 100 and two audio inputs. The majority of the components of the hearing aid system 200 are similar to those of the hearing aid system 100 and are labeled with reference numerals that are offset by 100. However, the hearing aid system 200 includes an additional audio sensor 213 for receiving an acoustic signal 235 and transducing this signal to provide a corresponding electronic acoustic signal 237. Both of the audio sensors 212 and 213 may be omni-directional microphones. Alternatively, one of the audio sensors 212 and 213 may be an omni-directional microphone and the other may be a directional microphone. The electronic acoustic signal 237 is provided to a selector 252 which may be a multiplexer, however, any suitable selection device may be used. In addition, the tele-coil circuit 214 is connected to the multiplexer 252 for providing the electronic magnetic signal 242 to the multiplexer 252. The multiplexer 252 provides one of the electronic magnetic signal 242 and the electronic acoustic signal 237 as an input to the ADC 218 which digitizes this input and provides an input signal 245 to the system processor 220 for further processing. The selection of one of the electronic magnetic signal 242 and the electronic acoustic signal 237 is made based on a SELECT signal provided by the magnetic signal detector 226. More particularly, the SELECT signal is provided by the magnetic signal analyzer 232. When the status signal S indicates a positive likelihood for several segments of the electronic magnetic signal 242, the magnetic signal analyzer 232 adjusts the SELECT signal so that the multiplexer 252 passes the electronic magnetic signal 242 to the ADC 218. The hearing aid system 200 then performs as described previously for the hearing aid system 10. However, when the status signal S indicates a negative or poor likelihood, then the magnetic signal analyzer 232 adjusts the SELECT signal so that the multiplexer 252 passes the electronic acoustic signal 237 to ADC 218. In this case, the input digital acoustic signal 238 and the input digital signal 245 are provided to the hearing aid module 228 which may process these signals according to an omni-directional or directional microphone mode. Any suitable omni-directional and directional processing schemes may be used as is well known to those skilled in the art. For instance, fixed directional or adaptive directional processing schemes may be used.

The hearing aid system 200 preferably employs circuitry in the magnetic signal pre-detector 230 that is separate from the system processor 220 for implementing the magnetic signal pre-detection process 60. The circuitry is described in more detail below. The separate processing of the magnetic signal pre-detection process 60 is beneficial for reducing the computational overhead of the system processor 220 which is typically dedicated to processing up to two acoustic input signals 238 and 245 when the electronic magnetic signal 242 does not contain audio information. The topology of the hearing aid system 200 is also beneficial since most digital signal processor platforms used for hearing aids usually comprise two analog-to-digital conversion channels. Accordingly, it is difficult for the digital signal processor of a modern hearing aid to sample and process all three signals (i.e. the two input acoustic signals and the input magnetic signal) at the same time. In addition, sampling and processing all three signals would increase the power consumption of the hearing aid digital signal processor. The topology of the hearing aid system 200 furthermore enables both the acoustic input signal 236 and the magnetic input signal 242 to be combined and processed in the hearing aid module 228 according to an MT (microphone+telecoil) program, a hearing aid program that is well known by those practiced in the art.

Figure 4:
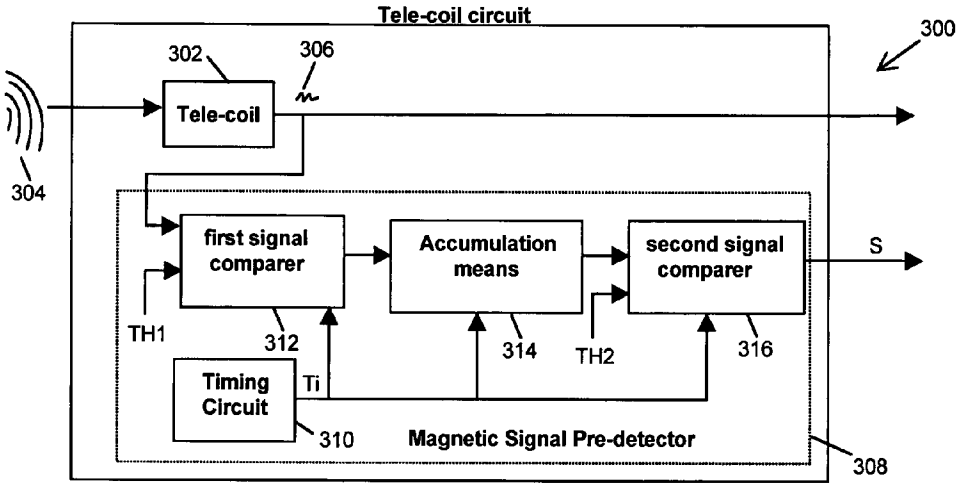
FIG. 4 is a block diagram of the tele-coil circuit of the hearing aid system of FIG. 3*a* or 3*b*; and, FIG. 5 is a block diagram of an alternative embodiment of the tele-coil circuit of the hearing aid system of FIG. 3*a* or 3*b*.

Referring now to FIG. 4, shown therein is a block diagram of a tele-coil circuit 300 which may be used as the tele-coil circuit 114 or 214 of the hearing aid systems 100 and 200 respectively. The tele-coil circuit 300 comprises a tele-coil 302 for sensing a magnetic field signal 304 and providing an electronic input magnetic signal 306. The tele-coil 302 is preferably an active tele-coil with an amplifier but may also be a passive tele-coil or the like. The tele-coil circuit 300 also includes a magnetic pre-detector 308 that comprises a timing circuit 310, a first signal comparer 312, an accumulation means 314 and a second signal comparer 316 connected as shown in FIG. 4. The magnetic signal pre-detector 308 also comprises circuitry for generating threshold values TH1 and TH2 as is well known to those skilled in the art. For instance voltage dividers incorporating resistors with appropriate values may be connected to the positive node of the power supply of the hearing aid system to generate the threshold values TH1 and TH2. The tele-coil circuit 300 may be implemented using discrete components or may be implemented as an application specific integrated circuit. In either case, the circuitry must be specialized (i.e. have low power consumption and low noise) for use in a hearing aid.

The timing circuit 310 comprises circuitry for providing timing information for segmenting the electronic input magnetic signal 306 into segments having time duration T. The timing circuit 310 also comprises circuitry for providing timing information for sampling amplitude values of the electronic input magnetic signal 306 at specific time samples. These two circuits may comprise RC timing circuitry or other suitable circuitry having low power consumption as is well known to those skilled in the art. The timing circuit 310 provides a timing signal Ti, having the segmenting and sampling timing information, to the first signal comparer 312, the accumulation means 314 and the second signal comparer 316.

The first signal comparer 312 is connected to the tele-coil circuit 302 to receive the electronic input magnetic signal 306. The first signal comparer 312 applies the threshold value TH1 to the electronic input magnetic signal 306 in accordance with step 64 of the magnetic signal pre-detection process 60. The first signal comparer 312 provides an output signal which may be a difference signal that indicates the difference in magnitude between the electronic input magnetic signal 306 and the threshold value TH1. Alternatively, the output signal may be a binary signal that has a high(low) value when the amplitude of a sample of the electronic input magnetic signal 306 is larger(smaller) than the threshold value TH1. In the first instance, the first signal comparer 312 may be a differencing amplifier and the accumulation means 314 then operates on the output signal according to equation 1, or a modification thereof, to implement step 66 of the magnetic signal pre-detection process 60 and provide an accumulated overshoot value. Accordingly, the accumulation means 314 may be an integrator or other suitable circuitry for implementing equation 1. In the second instance, the first signal comparer 312 may be a comparator and the accumulation means 314 then operates on the output signal according to equation 2, or a modification thereof, to implement step 66 of the magnetic signal pre-detection process 60 and provide an accumulated overshoot value. Accordingly, the accumulation means 314 may be a counter or other suitable circuitry for implementing equation 2. In either case, the second signal comparer 316 then compares the accumulated overshoot value to the second threshold value TH2 to provide a status value for the status signal S corresponding to the segment of the electronic input magnetic signal 306 that was just processed. Accordingly, the second signal comparer 316 may be a comparator or the like.

Figure 5:
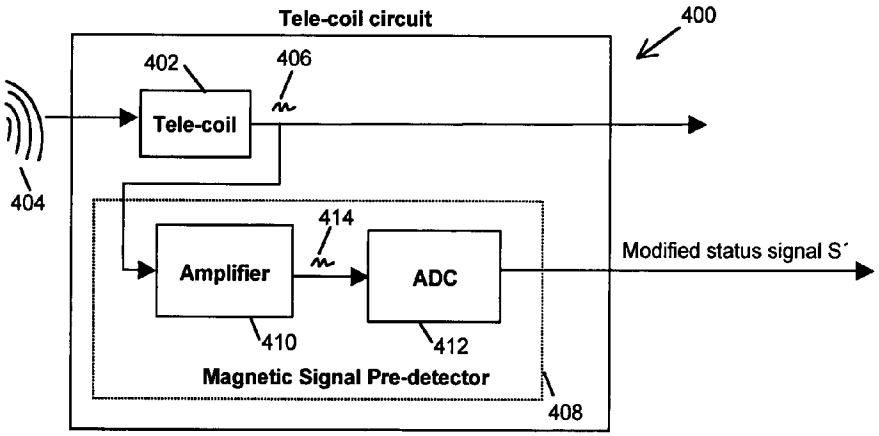

Referring now to FIG. 5, shown therein is a block diagram of an alternative embodiment of a tele-coil circuit 400 which may be used as the tele-coil circuit 114 or 214 of the hearing aid systems 100 and 200 respectively. The tele-coil circuit 400 comprises a tele-coil 402 for sensing a magnetic field signal 404 and providing an electronic input magnetic signal 406. As mentioned previously, the tele-coil 402 is preferably an active tele-coil with an amplifier but may also be a passive tele-coil or the like. The tele-coil circuit 400 also includes a magnetic signal pre-detector 408 that incorporates more simplified circuitry than the magnetic signal pre-detector 308. The magnetic signal pre-detector 408 comprises an amplifier 410 and a level converter which in this exemplary embodiment is an analog to digital converter (ADC) 412. The magnetic signal pre-detector 400 implements a modified magnetic signal pre-detection process. The components of the magnetic signal pre-detector 400 are preferably implemented using specialized discrete components that have low power consumption and low noise.

The amplifier 410 amplifies the electronic input magnetic signal 406 with an amplification factor A to provide an amplified electronic input magnetic signal 414 which the ADC 412 samples to provide a modified status signal S'. ADC 412 may be any level converting device with at least one low to high level transition threshold operating at the required sampling speed. The amplifier 410 is preferably a two-stage amplifier with the first amplifier being a unity gain voltage follower, or the like, for isolating the second stage of the amplifier from the tele-coil 402, and the second stage of the amplifier is any suitable amplifier 410 that can provide the amplification factor A. The ADC 412 is preferably a 1-bit ADC with a low-to-high transition threshold VLH and a low sampling frequency (e.g. 2 kHz). Any sample of the electronic input magnetic signal 414 that has an amplitude that is higher than the low-to-high transition threshold VLH is converted to a logic level 1 and correspondingly any sample of the electronic input magnetic signal 414 that has an amplitude that is lower than the low-to-high transition threshold VLH is converted to a logic level 0. Accordingly, the amplification factor A of the amplifier 410 is selected such that the amplified threshold value A*TH1 coincides with the low-to-high transition threshold VLH. Accordingly, the output of the ADC 412 is a modified status signal S' with a plurality of 1's and 0's for a given segment of the input magnetic signal 414. In this case, the magnetic signal analyzer is modified to process the modified status signal S' for each segment of the input magnetic signal by calculating the accumulated overshoot value by simply counting the number of 1's in the modified status signal S' for a given segment and comparing this number to threshold value TH2. If several segments have an accumulated overshoot value that is larger than the threshold value TH2, then the magnetic signal analyzer will perform the second stage of the magnetic signal detection process as described previously. In this case, the magnetic signal analyzer also performs a counting function. If the number of counts exceeds a given threshold in a specified time period, then there is a high likelihood that the input magnetic signal contains audio information and the second stage of the magnetic detection process is performed.

It should be understood that various modifications can be made to the embodiments described and illustrated herein, without departing from the present invention, the scope of which is defined in the appended claims.

What is claimed is:

1. A hearing aid system comprising:

a) an acoustic sensor for sensing an acoustic signal and providing an input acoustic signal, the input acoustic signal having acoustic information;

b) a magnetic sensor for sensing a magnetic field signal and providing an input magnetic signal, the input magnetic signal having magnetic information;

c) a magnetic signal detector connected to the magnetic sensor and the acoustic sensor for selecting one of the input acoustic signal and the input magnetic signal as an information signal, wherein the magnetic signal detector selects the input magnetic signal as the information signal after a magnetic signal detection process has at least partially analyzed the input magnetic signal in order to determine if the input magnetic signal may include audio information; and, d) a hearing aid module connected to the magnetic signal detector for processing the information signal and providing an output signal to a user of the hearing aid system.

2. The hearing aid system of claim 1, wherein the magnetic signal detector comprises a magnetic signal pre-detector for performing a first stage of the magnetic signal detection process by segmenting the input magnetic signal into a plurality of input magnetic signal segments each having a portion of the magnetic information, and providing a status signal for indicating whether a portion of the magnetic information in several of the plurality of input magnetic signal segments may include audio information.

3. The hearing aid system of claim 2, wherein the magnetic signal pre-detector provides a status value for the status signal for one of the plurality of input magnetic signal segments by comparing an accumulated overshoot value with a second threshold value.

4. The hearing aid system of claim 3, wherein the one of the plurality of input magnetic signal segments comprises a plurality of samples and the accumulated overshoot value is a sum of the plurality of samples having an amplitude value greater than a first threshold value.

5. The hearing aid system of claim 3, wherein the one of the plurality of input magnetic signal segments comprises a plurality of samples and the accumulated overshoot value is an integral, wherein an integrand of the integral is a difference between an amplitude value of one of the plurality of samples and a first threshold value, the integral being taken over the plurality of samples having an amplitude value greater than the first threshold value.

6. The hearing aid system of claim 2, wherein the magnetic signal detector further comprises a magnetic signal analyzer connected to the magnetic signal pre-detector for performing a second stage of the magnetic signal detection process when the status signal indicates that audio information may be present in several segments of the plurality of input magnetic signal segments, by analyzing the portion of the magnetic information in the several of the plurality of input magnetic signal segments to determine if the portion of the magnetic information includes audio information.

7. The hearing aid system of claim 6, wherein the magnetic signal analyzer analyses at least one of temporal, amplitude and frequency components of the portion of magnetic information for determining if the portion of magnetic information includes audio information.

8. The hearing aid system of claim 6, wherein the magnetic signal analyzer employs a multi-dimensional detection process for determining if the portion of magnetic information includes audio information.

9. The hearing aid system of claim 2, wherein the magnetic sensor is a tele-coil circuit comprising a tele-coil and the magnetic signal pre-detector, the tele-coil being adapted for sensing the magnetic field signal and providing the input magnetic signal, the magnetic signal pre-detector being connected to the tele-coil.

10. The hearing aid system of claim 9, wherein the signal magnetic pre-detector comprises:

e) a timing circuit for providing timing information for segmenting the input magnetic signal into the plurality of input magnetic signal segments and for sampling the plurality of input magnetic signal segments;

f) a first signal comparer connected to the timing circuit and the tele-coil for comparing amplitudes values in the one of the plurality of input magnetic signal segments with a first threshold value for the one of the plurality of input magnetic signal segments;

g) an accumulation means connected to the first signal comparer and the timing circuit for calculating the accumulated overshoot value based on the amplitude values that are greater than the first threshold value; and, h) a second signal comparer connected to the timing circuit and the accumulation means for comparing the accumulated overshoot value with a second threshold value and providing a status value for the status signal corresponding to the one of the plurality of input magnetic signal segments.

11. The hearing aid system of claim 10, wherein the accumulation means is a counter for providing a sum as the accumulated overshoot value, the sum being the number of the amplitude values that are greater than the first threshold value.

12. The hearing aid system of claim 10, wherein the accumulation means is an integrator for providing an integral as the accumulated overshoot value, wherein an integrand of the integral is a difference of one of the amplitude values and the first threshold value, the integrator performing the integral over the amplitude values that are greater than the first threshold value.

13. The hearing aid system of claim 9, wherein the magnetic signal pre-detector comprises:

e) an amplifier connected to the tele-coil for amplifying the input magnetic signal with an amplification factor; and, f) a level converter connected to the amplifier for providing a logic level signal for the status signal, the level converter having at least one low-to-high transition threshold;

wherein the amplification factor is selected to utilize the at least one low-to-high transition threshold of the level converter as a threshold for the input magnetic signal to generate a plurality of status values for the status signal for one of the plurality of input magnetic signal segments.

14. The hearing aid system of claim 9, wherein the system further comprises:

e) a second acoustic sensor for sensing a second acoustic signal and providing a second input acoustic signal; and, f) a selector connected to the second acoustic sensor and the tele-coil for selecting one of the input magnetic signal and the second input acoustic signal as an input signal for the magnetic signal detector, wherein the input magnetic signal is selected as the input signal when the status signal indicates that audio information may be present in several of the input magnetic signal segments.

15. A method of operating a hearing aid system comprising:

a) sensing an acoustic signal and providing an input acoustic signal, the input acoustic signal having acoustic information;

b) sensing a magnetic field signal and providing an input magnetic signal, the input magnetic signal having magnetic information;

c) selecting one of the input acoustic signal and the input magnetic signal as an information signal, wherein the input magnetic signal is selected as the information signal after a magnetic signal detection process has at least partially analyzed the input magnetic signal in order to determine if audio information may be present in the input magnetic signal; and, d) processing the information signal and providing an output signal to a user of the hearing aid system.

16. The method of claim 15, wherein a first stage of the magnetic signal detection process comprises:

e) segmenting the input magnetic signal into a plurality of input magnetic signal segments each having a portion of the magnetic information; and, f) providing a status signal for indicating that the portion of the magnetic information in several of the plurality of input magnetic signal segments may comprise audio information.

17. The method of claim 16, wherein step (f) comprises providing a status value for the status signal for one of the plurality of input magnetic signal segments by comparing an accumulated overshoot value with a second threshold value.

18. The method of claim 17, wherein the one of the plurality of input magnetic signal segments comprises a plurality of samples and the accumulated overshoot value is a sum of the plurality of samples having an amplitude value greater than a first threshold value.

19. The method of claim 17, wherein the one of the plurality of input magnetic signal segments comprises a plurality of samples and the accumulated overshoot value is an integral, wherein an integrand of the integral is a difference between an amplitude value of one of the plurality of samples and a first threshold value, the integral being taken over the plurality of samples having an amplitude value greater than the first threshold value.

20. The method of claim 16, wherein a second stage of the magnetic signal detection process is performed when the status signal indicates that audio information may be present in several of the plurality of input magnetic signal segments, the second stage comprising analyzing the portion of the magnetic information in the several of the plurality of input magnetic signal segments to determine if the portion of the magnetic information includes audio information.

21. The method of claim 20, wherein analyzing the portion of the magnetic information comprises analyzing at least one of temporal, amplitude and frequency components of the portion of magnetic information for determining if the portion of magnetic information includes audio information.

22. The hearing aid system of claim 20, wherein analyzing the portion of the magnetic information comprises employing a three-dimensional detection process for determining if the portion of magnetic information includes audio information.

23. A tele-coil circuit for a hearing aid system comprising:

a) a tele-coil for sensing a magnetic field signal and providing an input magnetic signal to the hearing aid system, the input magnetic signal having magnetic information; and, b) a magnetic signal pre-detector connected to the tele-coil for at least partially analyzing some portions of the input magnetic signal in order to determine whether audio information may be present and providing a status signal to the hearing aid system, the status signal indicating that portions of the magnetic information may include audio information.

24. The tele-coil circuit of claim 23, wherein the magnetic signal pre-detector comprises:

c) a timing circuit for providing timing information for segmenting the input magnetic signal into a plurality of input magnetic signal segments and for sampling the plurality of input magnetic signal segments;

d) a first signal comparer connected to the timing circuit and the tele-coil for comparing amplitudes values in one of the plurality of input magnetic signal segments with a first threshold value;

e) an accumulation means connected to the first signal comparer and the timing circuit for calculating an accumulated overshoot value based on the amplitude values that are greater than the first threshold value for the one of the plurality of input magnetic signal segments; and, f) a second signal comparer connected to the timing circuit and the accumulation means for comparing the accumulated overshoot value with a second threshold value and providing a status value for the status signal corresponding to the one of the plurality of input magnetic signal segments.

25. The tele-coil circuit of claim 24, wherein the accumulation means is a counter for providing a sum as the accumulated overshoot value, the sum being the number of the amplitude values that are greater than the first threshold value.

26. The tele-coil circuit of claim 24, wherein the accumulation means is an integrator for providing an integral as the accumulated overshoot value, wherein an integrand of the integral is a difference of one of the amplitude values and the first threshold value, the integrator performing the integral over the amplitude values that are greater than the first threshold value.

27. The hearing aid system of claim 23, wherein the magnetic signal pre-detector comprises:

c) an amplifier connected to the tele-coil for amplifying the input magnetic signal with an amplification factor; and, d) a level converter connected to the amplifier for providing a logic level signal for the status signal, the level converter having at least one low-to-high transition threshold, wherein the amplification factor is selected to utilize the at least one low-to-high transition threshold of the analog-to-digital converter as a threshold for the input magnetic signal to generate status values for the status signal.

28. A hearing aid system comprising:

a) an acoustic sensor for sensing an acoustic signal and providing an input acoustic signal, the input acoustic signal having acoustic information;

b) a magnetic sensor for sensing a magnetic field signal and providing an input magnetic signal, the input magnetic signal having magnetic information;

c) a magnetic signal detector connected to the magnetic sensor and the acoustic sensor for selecting one of the input acoustic signal and the input magnetic signal as an information signal, wherein the magnetic signal detector process employs a two-stage magnetic detection process, wherein a first stage of the two-stage magnetic detection process at least partially analyzes the input magnetic signal in order to determine whether audio information may be present in a portion of the input magnetic signal, and wherein a second stage of the two-stage magnetic detection analyzes the portion of the input magnetic signal to determine if the portion of the magnetic information includes audio information, the second stage being performed when the first stage indicates that audio information may be present in the input magnetic signal; and, d) a hearing aid module connected to the magnetic signal detector for processing the information signal and providing an output signal to a user of the hearing aid system.

29. A hearing aid system comprising:

a) an acoustic sensor for sensing an acoustic signal and providing an input acoustic signal, the input acoustic signal having acoustic information;

b) a magnetic sensor for sensing a magnetic field signal and providing an input magnetic signal, the input magnetic signal having magnetic information;

c) a magnetic signal detector connected to the magnetic sensor and the acoustic sensor for selecting one of the input acoustic signal and the input magnetic signal as an information signal, wherein the magnetic signal detector selects the input magnetic signal as the information signal after a magnetic signal detection process has at least partially analyzed an alternating portion of the input magnetic signal in order to determine if the input magnetic signal may contain audio information; and, d) a hearing aid module connected to the magnetic signal detector for processing the information signal and providing an output signal to a user of the hearing aid system.

30. A method of operating a hearing aid system comprising:

a) sensing an acoustic signal and providing an input acoustic signal, the input acoustic signal having acoustic information;

b) sensing a magnetic field signal and providing an input magnetic signal, the input magnetic signal having magnetic information;

c) selecting one of the input acoustic signal and the input magnetic signal as an information signal, wherein the input magnetic signal is selected as the information signal after a magnetic signal detection process has at least partially analyzed an alternating portion of the input magnetic signal in order to determine if the input magnetic signal may contain audio information; and, d) processing the information signal and providing an output signal to a user of the hearing aid system.

* * * * *

UNITED STATES PATENT AND TRADEMARK OFFICE

CERTIFICATE OF CORRECTION

PATENT NO. : 7,010,132 B2
APPLICATION NO. : 10/452731
DATED : March 7, 2006
INVENTOR(S) : Henry Luo et al.

It is certified that error appears in the above-identified patent and that said Letters Patent is hereby corrected as shown below:

In the Detailed Description of the Invention, column 6, line 52, the word "section" has been changed to --selection--, so that the line reads --the digital input magnetic signal 44, and the selection signal--

In the Detailed Description of the Invention, column 10, line 15, equation (1) has been changed to -- $AOS(T_{n-1}, T_n) = \frac{1}{2}\int_{T_{n-1}}^{T_n} \left[S(t) - TH1\right] * \{sign\left[S(t) - TH1\right] + 1\} dt$ --

In the Detailed Description of the Invention, column 10, line 45, equation (2) has been changed to -- $AOS(N_{m-1}, N_m) = \frac{1}{2}\sum_{N_{m-1}}^{N_m} \{sign\left[S(n) - TH1\right] + 1\}$ --

In the Detailed Description of the Invention, column 13, line 47, the word "VLH" has been changed to --$V_{LH}$--, so that the line reads --ADC with a low-to-high transition threshold $V_{LH}$ and a low--

In the Detailed Description of the Invention, column 13, line 50, the word "VLH" has been changed to --$V_{LH}$--, so that the line reads --is higher than the low-to-high transition threshold $V_{LH}$ is--

In the Detailed Description of the Invention, column 13, line 54, the word "VLH" has been changed to --$V_{LH}$--, so that the line reads --threshold $V_{LH}$ is converted to a logic level 0. Accordingly,"

In the Detailed Description of the Invention, column 13, line 57, the word "VLH" has been changed to --$V_{LH}$--, so that the line reads --with the low-to-high transition threshold $V_{LH}$. Accordingly,--

In the Claims, column 15, line 26, claim 10, the word "amplitudes" has been changed to --amplitude--, so that the line reads --and the tale-coil for comparing amplitude values in the--

UNITED STATES PATENT AND TRADEMARK OFFICE

CERTIFICATE OF CORRECTION

PATENT NO. : 7,010,132 B2
APPLICATION NO. : 10/452731
DATED : March 7, 2006
INVENTOR(S) : Henry Luo et al.

It is certified that error appears in the above-identified patent and that said Letters Patent is hereby corrected as shown below:

In the Claims, column 17, line 27, claim 24, the word "amplitudes" has been changed to --amplitude--, so that the line reads --and the tale-coil for comparing amplitude values in the--

Signed and Sealed this

Fourth Day of September, 2007

JON W. DUDAS
*Director of the United States Patent and Trademark Office*

UNITED STATES PATENT AND TRADEMARK OFFICE

CERTIFICATE OF CORRECTION

PATENT NO. : 7,010,132 B2
APPLICATION NO. : 10/452731
DATED : March 7, 2006
INVENTOR(S) : Henry Luo et al.

It is certified that error appears in the above-identified patent and that said Letters Patent is hereby corrected as shown below:

Column 15, line 26, claim 10, the word "tale-coil" has been changed to --tele-coil--, so that the line reads --and the tele-coil for comparing amplitude values in the--

Column 17, line 27, claim 24, the word "tale-coil" has been changed to --tele-coil--, so that the line reads --and the tele-coil for comparing amplitude values in--

Signed and Sealed this

Eighteenth Day of December, 2007

JON W. DUDAS
*Director of the United States Patent and Trademark Office*